United States Patent [19]

Shoe

[11] 4,100,713

[45] Jul. 18, 1978

[54] STRUCTURAL CONNECTION

[75] Inventor: Theodore W. Shoe, Fletcher, Ohio

[73] Assignee: The Flexicore Co., Inc., Dayton, Ohio

[21] Appl. No.: 751,029

[22] Filed: Dec. 16, 1976

[51] Int. Cl.[2] ..... E04H 12/00; E06B 1/04

[52] U.S. Cl. ..... 52/648; 52/236.7; 52/263; 52/722; 52/726; 403/217; 403/292

[58] Field of Search ..... 52/585, 648, 236, 263, 52/295, 301, 726, 637, 236.3, 79.13, 236.7, 236.8, 578, 283, 227, 403, 217, 219; 403/217, 292, 298, 722, 726

[56] References Cited

U.S. PATENT DOCUMENTS

| | | | |
|---|---|---|---|
| 2,305,563 | 12/1942 | Uecker et al. | 52/637 X |
| 2,478,088 | 8/1949 | Causey | 52/637 |
| 2,575,461 | 11/1951 | North | 52/637 |
| 2,665,950 | 1/1954 | Johnson | 52/637 |
| 3,036,407 | 5/1962 | Dixon | 52/585 |
| 3,429,092 | 2/1969 | Perry et al. | 52/648 |
| 3,594,971 | 7/1971 | Hughes | 52/236.7 X |
| 3,726,362 | 4/1973 | Puckett | 52/637 X |
| 3,824,750 | 7/1974 | Antoniou | 52/79.13 |
| 4,012,880 | 3/1977 | Logie | 52/585 |

*Primary Examiner*—Alfred C. Perham
*Assistant Examiner*—Robert C. Farber
*Attorney, Agent, or Firm*—Biebel, French & Nauman

[57] ABSTRACT

A structural connection between adjacent ends of vertically superimposed precast columns in a structural framework of precast beams and columns. As in precast columns of the prior art sections of tubing are cast in the columns and extend longitudinally of them. However, the tubing at one end of the columns, rather than terminating at or just beyond the column end face, projects outwardly of the column a substantial distance, preferably through an opening formed through a beam at a beam-column intersection where the column joint is formed, and one end of a spindle is received in this portion of tubing and also in a second portion of tubing projecting only a slight distance from the opposite end of the adjacent column. A washer or washers may be loosely attached to or merely slipped over the spindle to engage the opposed ends of the tubing and transfer loads from an upper to a lower column. This construction provides shorter length spindles and a direct transfer of loads from upper to lower columns.

6 Claims, 4 Drawing Figures

STRUCTURAL CONNECTION

BACKGROUND OF THE INVENTION

In the construction disclosed in U.S. Pat. No. 3,429,092, dated Feb. 25, 1969, a threaded connector is used to interconnect adjacent columns. In application Ser. No. 744,690, filed Nov. 24, 1976 and assigned to the assignee of this application, the threaded connector of said patent is replaced with a collar-spindle connector which eliminates reliance of interthread engagement for transferring vertical loads from one column to another.

SUMMARY OF THE INVENTION

The present invention provides a structural connection for interconnecting superimposed, vertically extending columns with a direct transfer of loads from upper to lower columns, but one in which the length of the spindle utilized can be appreciably shortened.

Specifically, the hollow tubing cast within and extending longitudinally of each of the columns is extended and projects a substantial distance outwardly from the end face of the column while it terminates at or a short distance beyond the opposite end face of the column. Preferably the extended portion of tubing is of sufficient length to project through an opening in a beam through which the joined columns extend and opposite ends of the spindle are received in the hollow tubing at the lower and upper ends of adjacent columns.

In accordance with one embodiment of the invention washers may be placed over the spindle to vary the elevation of the upper column and the spindle may be fixed within the extended portion of the tubing. In this regard the spindle may be fixed in the tubing by knurling an outside surface of the spindle to increase its diameter and allow it to be press fit in the tubing.

In accordance with another feature of the invention aligned openings can be formed through the spindle and extended tubing to permit a shackle and pin to be used in handling the column and thereafter, if desired, a bolt can be inserted through the aligned openings to insure that the spindle is not accidentally forced downward in the tubing.

DESCRIPTION OF THE PREFERRED EMBODIMENTS

Figure 1:
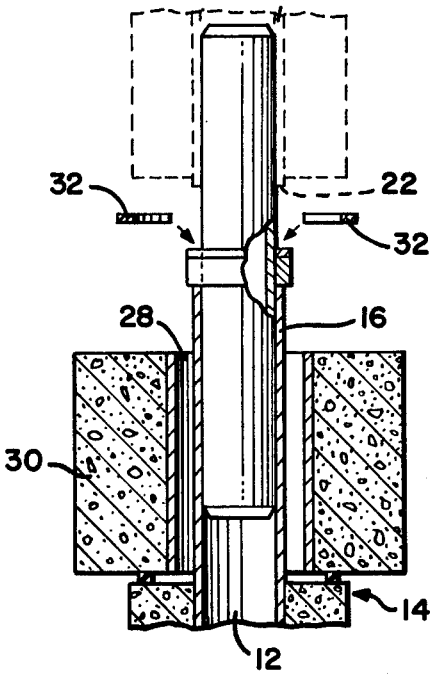
FIG. 1 is a cross sectional view showing components of a structural connection in accordance with a preferred embodiment of the invention.

As seen in FIG. 1 of the drawings a typical precast column has a main body portion 10 of concrete having embedded therein tubing or pipe 12 formed of steel or other suitable material. One end of the column, such as the upper end 14 thereof, has the tubing extended therefrom, as indicated at 16, while the opposite end 18 of the column has the tubing terminated a short distance from the end of the column as indicated at 20.

As the description proceeds it will be apparent that, although for purposes of illustration the tubing is shown as extended at the upper ends of the columns and terminated adjacent the lower end faces thereof, the tubing could also be extended at the lower ends of the columns within the scope of the present invention.

A spindle 22, which may be formed of a piece of hollow pipe or tubing, is received in opposite ends of a vertically superimposed columns and a collar 24 may be received on the spindle and fixed thereto by any means of connection which will reasonably assure that the collar and spindle remain attached, although it will be apparent from the following that any such connection need not be capable of any appreciable load resistance. Additionally, incremental washers 26 can be provided for varying the elevation of the upper column.

Figure 3:
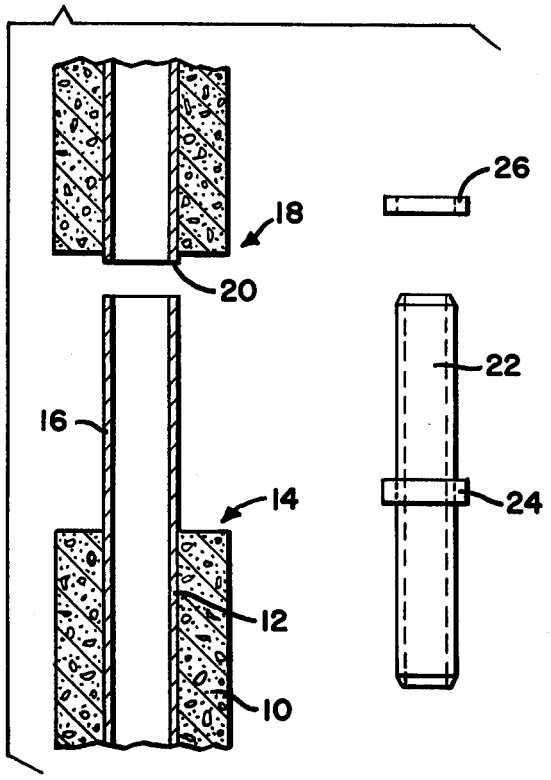
FIG. 3 is an exploded view with parts in section showing a structural connection of the type illustrated in FIG. 1.

As seen in FIG. 3 of the drawings, the extended end 16 of the tubing preferably projects upwardly through an opening 28 formed through a beam 30 at the connection between adjacent columns. It will also be noted that the incremental washers, if used, can be of the split variety, as shown at 32, to allow them to be placed in position after the upper end of the spindle has been received in the tubing at the lower end of the upper column.

Figure 4:
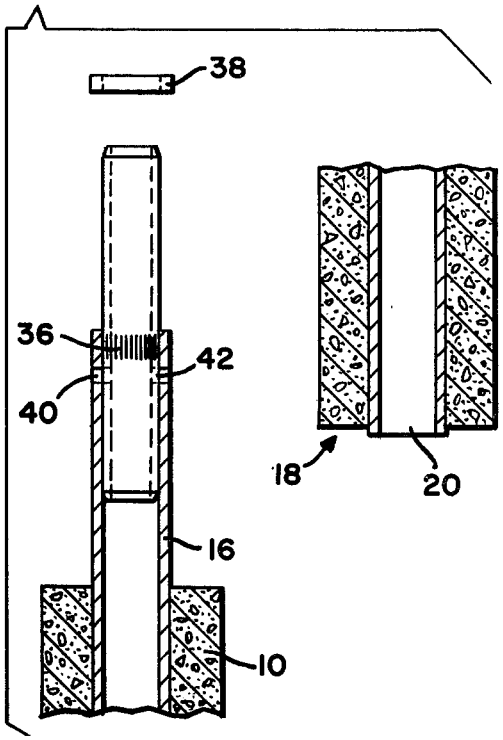
FIG. 4 is an exploded view showing additional features of the embodiment of FIG. 2.

It will often be desirable to fix the spindle in the extended end of the tubing. This is shown in FIG. 4 of the drawings wherein the spindle 34 is provided with knurling, as indicated at 36, to increase its outside diameter and allow the spindle to be press fit in the extended portion 16 of the tubing. With this construction it is unnecessary to fix a collar or washer to the spindle and washers, as at 38, can be simply slipped over the projecting end of the spindle 34.

Figure 2:
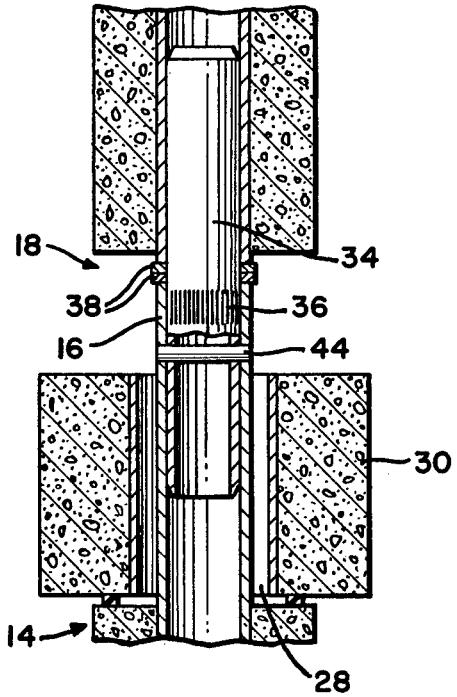
FIG. 2 is a view similar to FIG. 1, but showing additional features of the present invention.

Additionally, columns and spindles can be handled as a unit and in this regard it will be noted that aligned openings 40 and 42 can be formed through the extended tubing and spindle to allow a pin and shackle to be used in lifting the columns with the attached spindles and to thereafter permit a bolt or pin, as seen at 44 in FIG. 2 of the drawings, to be inserted through the aligned openings to prevent the spindle 34 from being accidentally driven down into the extended tubing 16.

Regardless of the particular embodiment of the invention utilized it will be seen from the above that a structural connection is provided which permits a shortened spindle to be utilized and provides certain other advantages with respect to prior art structures of this general type.

While the articles herein described constitute preferred embodiments of the invention, it is to be understood that the invention is not limited to these precise articles, and that changes may be made therein without departing from the scope of the invention.

What is claimed is:

1. In a precast concrete structural framework including vertically superimposed, upper and lower, precast columns each having hollow tubing cast therein and extending longitudinally thereof, spindle means received in said tubing in non-vertical load transmitting relationship to said columns, means encircling said spindle means and transferring vertical load from said upper to said lower column, and a precast beam having a vertically extending opening therethrough, said beam intersecting said superimposed columns with said opening in said beam at the intersection thereof with said columns, the improvement comprising:

a portion of said tubing in one of said columns extending a substantial distance beyond an end thereof through said opening in said beam and toward an opposing end of the other of said columns, and a portion of said tubing in said other of said columns extending therefrom no more than a short distance relative to said portion of said tubing extending a substantial distance beyond said end of said one of said columns.

2. The framework of claim 1 wherein:

said spindle means is fixed in one of said portions of said tubing.

3. The framework of claim 2 wherein:

said spindle means is fixed in said one of said portions of said tubing by knurling formed on an outside surface of said spindle to increase the diameter thereof.

4. The framework of claim 1 further comprising:

means defining aligned, transverse openings through said spindle means and said portion of said tubing extending a substantial distance beyond said end of said one of said columns.

5. The framework of claim 1 wherein:

said portion of said tubing extending a substantial distance beyond an end of said one of said columns extends upwardly beyond an upper end of said lower of said columns.

6. In a precast concrete structural framework including intersecting, precast beams and superimposed, precast columns each having hollow tubing cast therein and extending longitudinally thereof, an improved connection between adjacent upper and lower columns at a beam-column intersection comprising:

means defining an opening through a beam at said beam-column intersection, a first portion of said tubing in said lower column extending upwardly from an upper end of said lower column through said opening in said beam, a second portion of said tubing in said upper column extending from a lower end thereof a substantially smaller distance than said first portion of said tubing extends from said upper end of said lower column, a spindle received in said first and second portions of said tubing, said spindle being fixed in said first portion of said tubing and loosely received in said second tubing, means defining aligned, transverse openings through said spindle and said first portion of said tubing, a washer encircling said spindle and in surface engagement with ends of said first and second portions of said tubing, and loads from said upper column being transferred to said lower column substantially solely by means of bearing loads imposed on said washer without substantial resistance to said loads from said upper column by any connection between said washer and said spindle.

* * * * *